US007467674B2

(12) United States Patent
Green

(10) Patent No.: US 7,467,674 B2
(45) Date of Patent: Dec. 23, 2008

(54) ROCK DRILLING EQUIPMENT

(75) Inventor: Christopher James Green, Southowram (GB)

(73) Assignee: Halco Drilling International Limited (GB)

( * ) Notice: Subject to any disclaimer, the term of this patent is extended or adjusted under 35 U.S.C. 154(b) by 129 days.

(21) Appl. No.: 10/599,621

(22) PCT Filed: Apr. 5, 2005

(86) PCT No.: PCT/GB2005/001308

§ 371 (c)(1),
(2), (4) Date: Dec. 8, 2006

(87) PCT Pub. No.: WO2005/098192

PCT Pub. Date: Oct. 20, 2005

(65) Prior Publication Data

US 2008/0029307 A1 Feb. 7, 2008

(30) Foreign Application Priority Data

Apr. 7, 2004 (GB) ..... 0407947.1

(51) Int. Cl.
*E21B 10/38* (2006.01)

(52) U.S. Cl. ..... 175/296; 175/418

(58) Field of Classification Search ..... 175/296, 175/418, 417, 213

See application file for complete search history.

(56) References Cited

U.S. PATENT DOCUMENTS

| | | | | |
|---|---|---|---|---|
| 5,154,249 | A * | 10/1992 | Yardley | 180/168 |
| 5,778,993 | A | 7/1998 | Moir | |
| RE36,002 | E * | 12/1998 | Elsby et al. | 175/296 |
| 6,702,045 | B1 * | 3/2004 | Elsby | 175/93 |
| 2005/0199429 | A1 * | 9/2005 | Terlet et al. | 175/296 |
| 2007/0007045 | A1 * | 1/2007 | Lorger et al. | 175/296 |

FOREIGN PATENT DOCUMENTS

| | | |
|---|---|---|
| GB | 2296731 | 7/1996 |
| WO | WO 98/54433 | 12/1998 |

* cited by examiner

*Primary Examiner*—Hoang Dang
(74) *Attorney, Agent, or Firm*—Carlo A. Marmo; Arnold B. Silverman; Eckert Seamans Cherin & Mellott, LLC

(57) ABSTRACT

In a reverse circulation down-the-hole hammer assembly a having a axially extending central tube (30) for recovery of drilling debris, the central tube (30) has a downwardly facing abutment (32) and an upwardly facing upper end and is located axially in the hammer assembly by having the part thereof between the downwardly facing abutment and the upper end located between axially spaced complementary abutments, one of which fixed and the other of which is provided by a resiliently longitudinally displaceable member (42) within a casing part providing an upper end of the hammer assembly and which is removably retained in an adjoining part of the hammer assembly. The longitudinally displaceable member engages the upper end of the central tube and thus clamps the central tube in place.

4 Claims, 7 Drawing Sheets

FIG 5
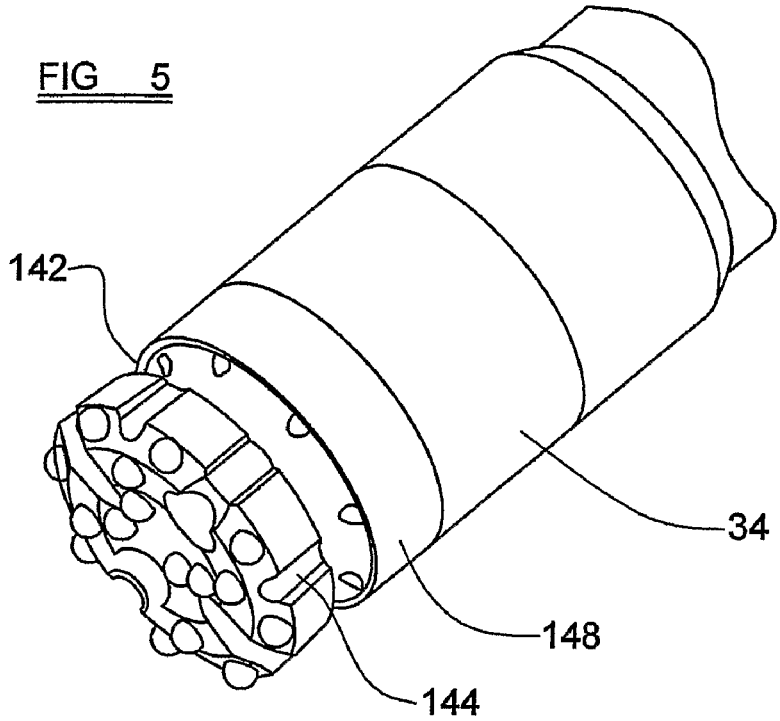
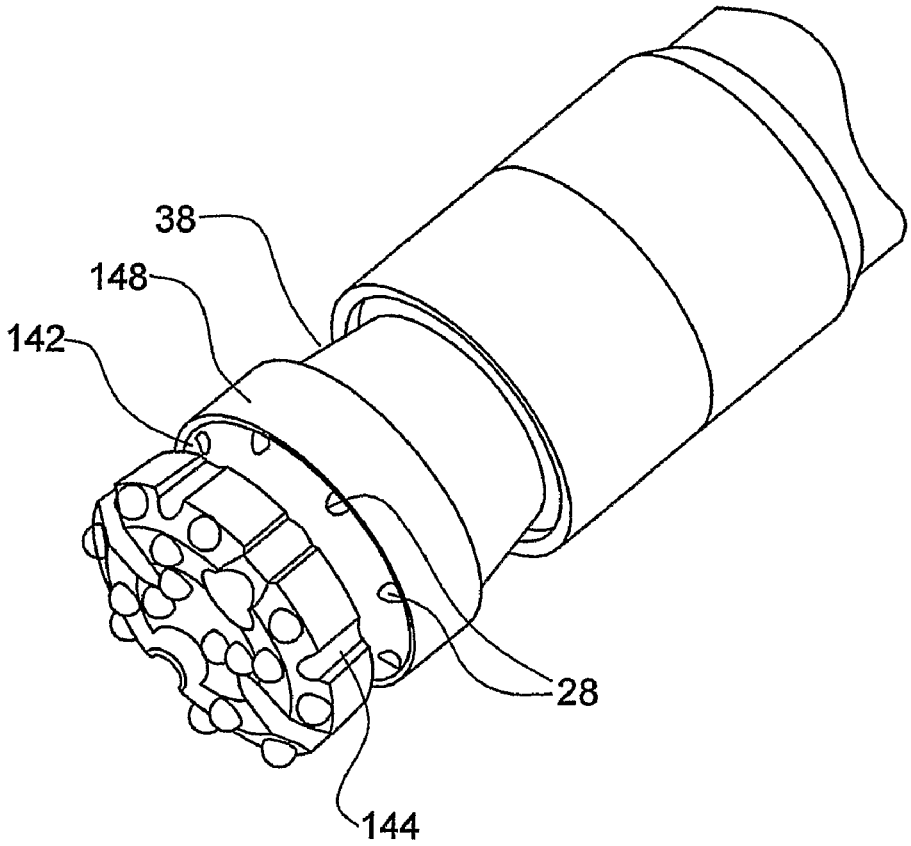
FIG 6

ROCK DRILLING EQUIPMENT

THIS INVENTION relates to rock drilling equipment. In particular, this invention relates to rock drills of the reverse circulation type in which compressed air is supplied to the bottom of the hole being drilled around the exterior of the drill bit, to pass across the face of the drill bit and up through an axial passageway through the drill bit, through a corresponding passageway in the drill string to the surface, carrying with it particles of rock, etc. removed from the bottom of the bore by the drill bit, for sampling purposes, etc. In such apparatus, the drill bit is carried in a so-called hammer forming the lowermost part of the drill string and which, besides holding the drill bit, incorporates a pneumatically operated piston by means of which successive blows are struck on the upper end of the drill bit shank, to cause the lower, operative end or head of the drill bit to break away material from the lower end of the bore. In such apparatus, the piston generally is an annular piston and the exhaust air and rock debris from the bore hole are conducted axially through the hammer by means of a central tube, communicating with further tubes extending through the drill string upward to the surface.

Such a central tube in the drill hammer is subject to erosion by the debris carried by the exhaust air stream and accordingly may require to be renewed or changed at intervals in the working life of the hammer. In a conventional drill hammer of this kind, the central tube is located axially between abutments provided by parts of the hammer structure and generally, in order to allow for manufacturing tolerances, it is necessary to arrange the relevant dimensions such that there is room for some axial play of the tube between abutment with the opposing abutment members in the hammer assembly. Furthermore, in these conventional reverse circulation hammers, replacement of the central tube requires substantial disassembly of the hammer with consequent risk that grit or other debris may find its way into the bore in which the piston works and/or into the associated air passages, leading to premature wear and/or seizure of the piston.

It is among the objects of the present invention to provide a reverse circulation hammer construction in which, in normal use, axial displacement of the central tube of the hammer assembly is significantly reduced as compared with the prior art.

It is another object of the present invention to provide a reverse circulation hammer assembly in which extraction of the central tube for replacement can be effected readily with less extensive disassembly of the hammer assembly than has been necessary with assemblies of the prior art.

According to one aspect of the invention there is provided a reverse circulation hammer assembly of the kind referred to in which one of the two abutments between which the central tube is located is provided by a structure within the hammer assembly and the other is provided by a second structure, further from the drill bit than said first structure and provided by a member which is longitudinally displaceable within a casing part providing an upper end of the hammer and which casing part is removably retained in the adjoining part of the hammer casing, said longitudinally displaceable part being resiliently biased towards the drill end of the hammer and thus clamping the part of the central tube providing abutments between the fixed abutment and the longitudinally displaceable one.

According to another aspect of the invention there is provided a down-the-hole hammer assembly comprising a tubular outer casing, a drill chuck having an upper part releasably secured within, for example screwed into, a lower end of said tubular outer casing, a drill bit having a drill shank received within said chuck and having and upper end projecting from the upper end of the chuck for engagement by a hammer, a retaining element such as a split ring around said projecting upper end of the drill bit shank, said hammer being reciprocable within guide means in the hammer assembly, including a guide bush the lower end of which normally engages said retaining element or split ring, and wherein a further retaining ring, for example an elastomeric O-ring, is located within an internal annular groove around the tubular casing and engages in a recess defied between a chamfer at the lower end of said guide bush and a chamfer at the upper end of said retaining element or split ring, whereby when the chuck, with the drill bit and retaining element or split ring is removed from said outer casing, said guide bush will be retained by said further retaining ring or O-ring.

According to a further aspect of the invention there is provided a reverse circulation drill of the kind specified in which, as regards those locations where the outer tube fits closely with respect to surrounding structures in the hammer assembly, such locations are of progressively increasing external diameter with distance from the drill bit end of the hammer.

According to a still further aspect of the invention, there is provided a drill bit for a reverse circulation rock drill, the drill bit having a head with an operative face and a shank of reduced diameter as compared with the operative face, the drill bit having one or more intake holes in the working face leading to a passage extending up the drill bit shank, the drill bit head having, at a location spaced from the operative face, a circumferential band or collar providing a cylindrical external surface coaxial with the drill bit, the diameter of said circumferential band or collar being substantially equal to the effective diameter of the working face of the drill bit and not less than the diameter of any other part of the drill bit, the drill bit having a circumferential groove around its exterior, below said circumferential band or collar and having passages for exhaust air discharging into said groove, whereby such air can pass around the front of the drill bit and across said face to exit through said intake holes.

Preferably a plurality of grooves or flutes distributed around the drill bit periphery extend longitudinally from said circumferential groove to the operative face of the drill bit.

Embodiments of the invention are described below with reference to the accompanying drawings in which:

FIGS. 5 and 6 are perspective views of the lower end of the hammer with the drill bit fitted, in the normal operative position (FIG. 5) and in a raised position (FIG. 6—(flushing mode))

Figure 1A:
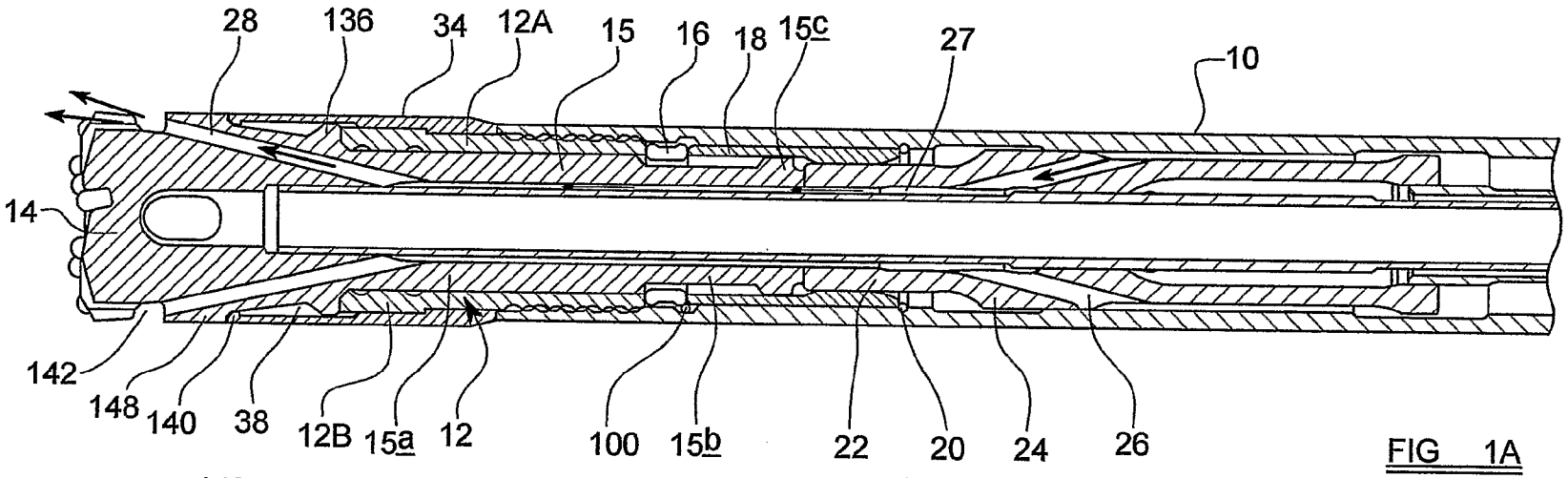
FIGS. 1A and 1B show, in different positions, and in mutually perpendicular longitudinal sections, the lower end of a rock drill hammer embodying the present invention.
Figure 1B:
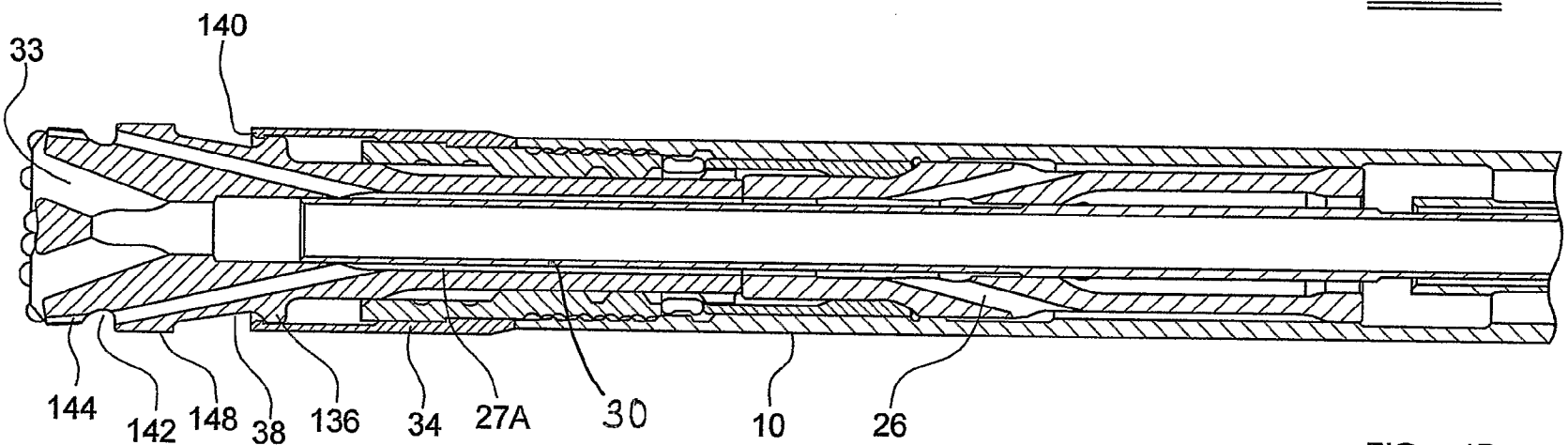

Referring to FIGS. 1A and 1B, a rock drilling hammer assembly comprises a tubular outer casing 10, a so-called drive sub or chuck 12 screwed into the lower end of the casing 10 and a drill bit 14. The drill bit has a head with a hard, (e.g. tungsten carbide), inserts, as is conventional, and has a shank 15 of reduced diameter with respect to the drill bit head. The shank 15 has a first longitudinally splined portion 15*a* received in a complementary splined portion of the drive sub 12, as is also conventional.

As shown in FIG. 1A, the drill bit shank 15 has, aft of the first splined portion 15*a*, a plain cylindrical bearing part 15*b* of a diameter as small as or smaller than the diametrical dimension measured across the grooves between the splines of portion 15*a*. The extreme rearward end of the drill bit shank has, over a portion 15*c*, a series of short longitudinal splines, the maximum diameter of this extreme rearward splined part 15*c* being greater than that of said plain cylindrical part 15*b*.

The drill bit is retained within the hammer structure by a split ring 16 which is located between the upper end of the drive sub 12 within the outer housing and the lower end of a piston guide bush or cyclic regulator 18 located within the outer housing 10 between a circlip 20 engaged in a circumferential groove around the interior of the housing 10 and the split ring 16. The portion 15*c* of the drill bit shank is a sliding fit in a lower portion of the axial bore through the bush 18. The piston guide bush or cyclic regulator 18 forms a seal and guide around a lower end portion 22 of a piston 24, of annular cross section, which acts as a hammer proper, the portion 22 effectively forming a tubular piston "rod" the free end of which, in operation, repeatedly strikes the upper end of the drill bit shank. In operation, the piston 24 is caused to reciprocate longitudinally within the casing 10, in manner known per se, by compressed air supplied via passages within the hammer. A porting arrangement formed in the piston and the adjoining parts of an interior wall of the hammer housing controls the flow of air above and below the piston 24 to effect such reciprocation, again well known manner.

The drill bit 14 is capable of limited longitudinal movement relative to the outer housing 10 and sub or chuck 12, to an extent determined by the axial length of the reduced cross-section portion 15*b* of the drill shank which receives the split ring 16, again known fashion. The drill bit has an axial bore extending from the upper (rear) end of the drill bit shank to a location within the drill bit head. A central tube 30 is coaxial with the outer housing and extends inside the housing, with a forward, (lower) part of the tube 30 extending within the axial bore in the drill bit. At its lower end, the tube 30 is a sliding fit within a lower part of the longitudinal axial bore within the drill bit.

Figure 1C:
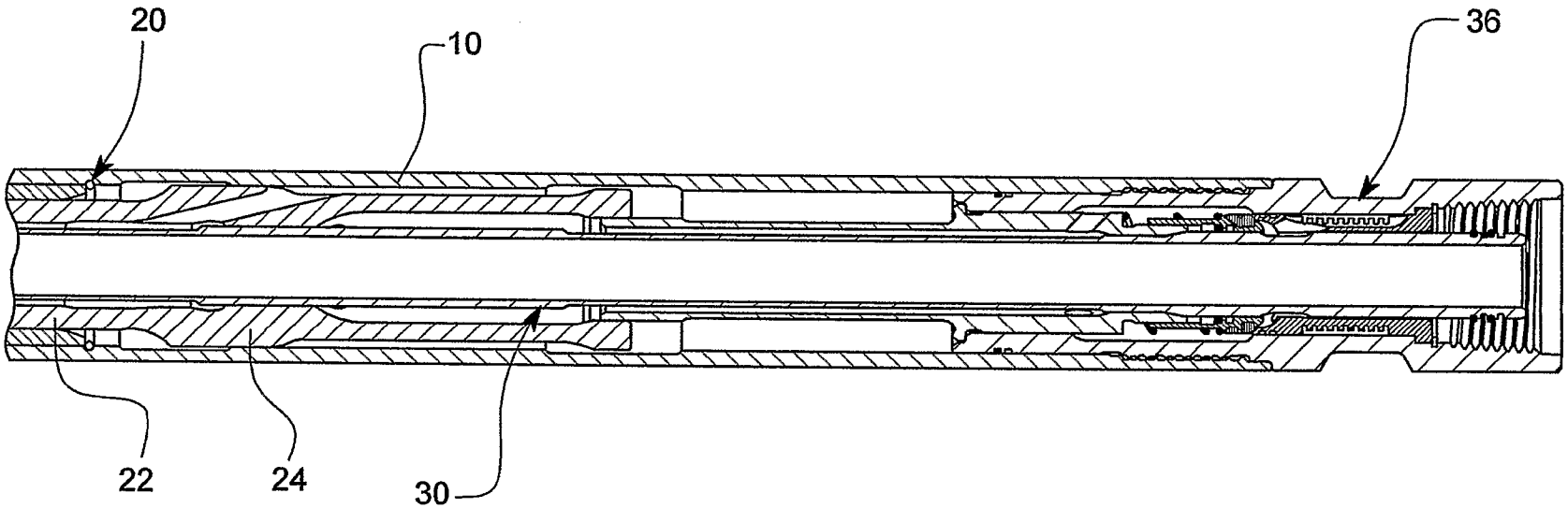
FIG. 1C is a longitudinal section view of an upper end of the rock drill hammer of FIGS. 1A and 1B.
Figure 2:
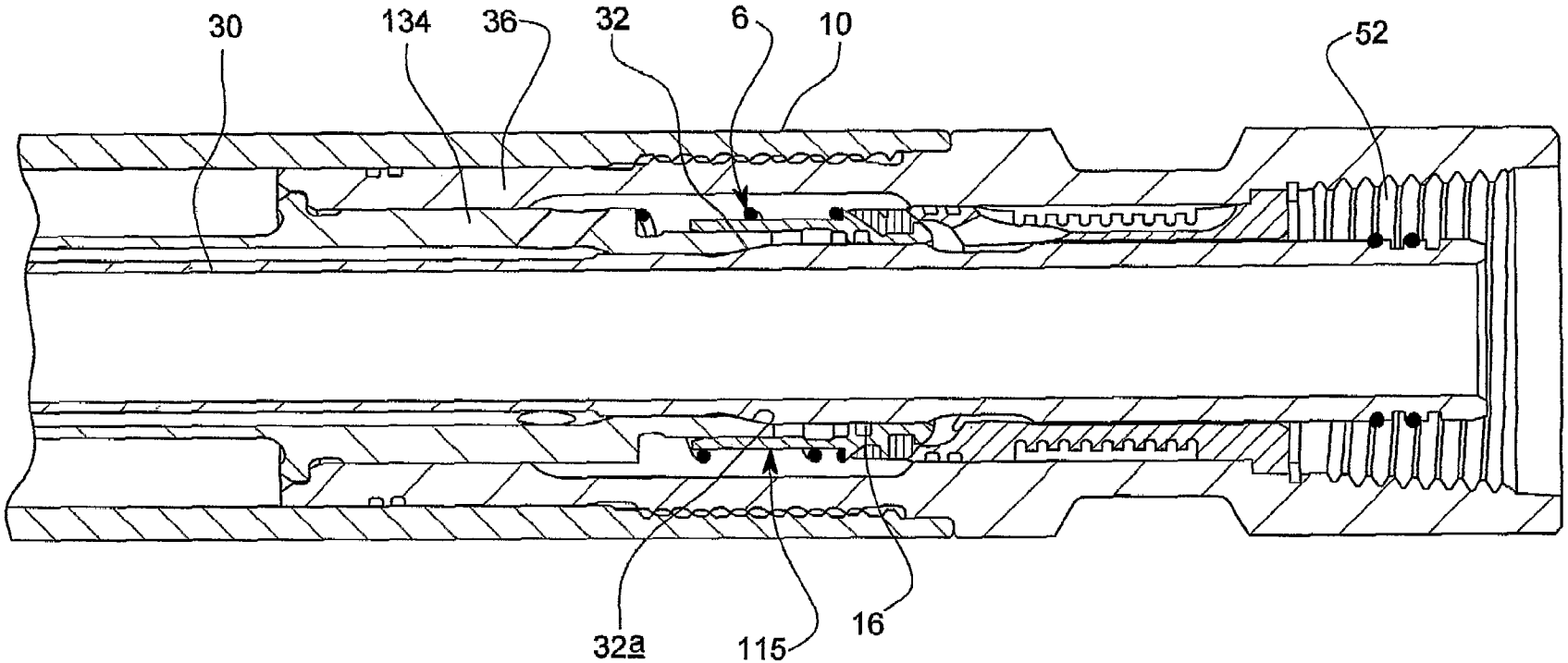
FIG. 2 is an enlarged view of part of FIG. 1C.
Figure 2A:
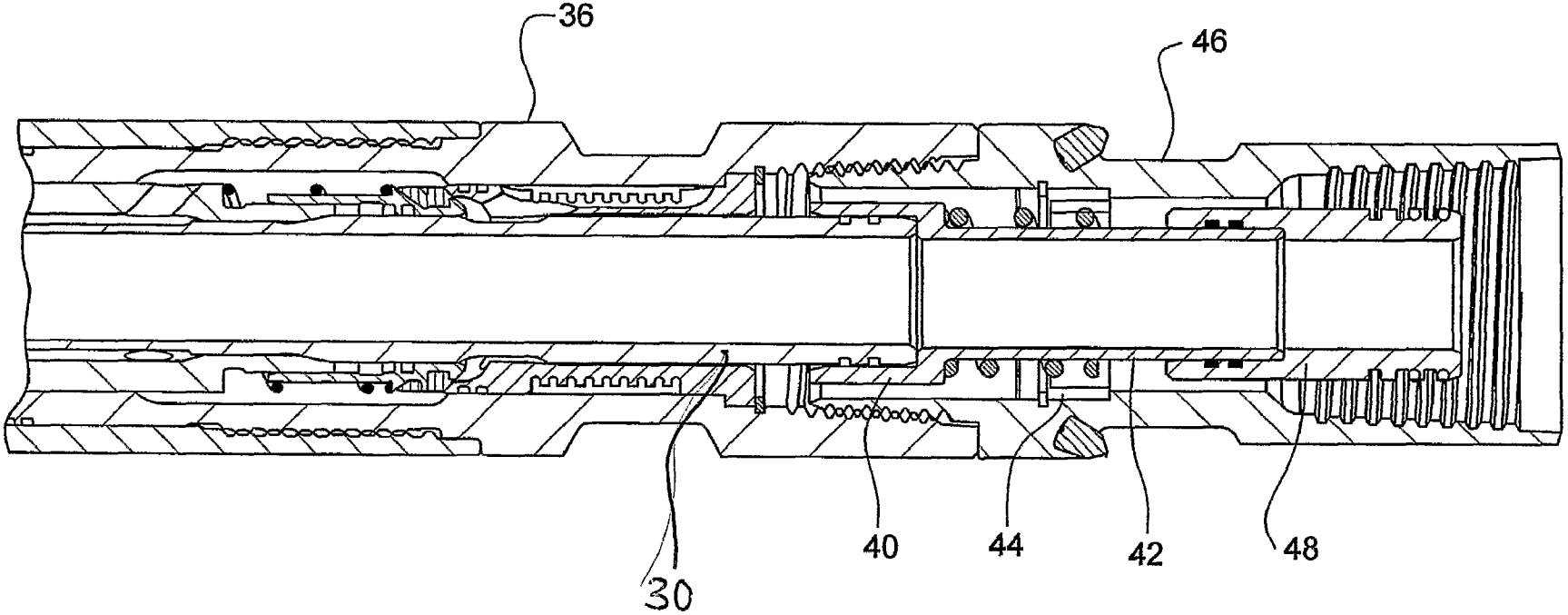
FIG. 2A is a longitudinal section view showing the parts illustrated in FIGS. 1C and 2 connected.
Figure 3:
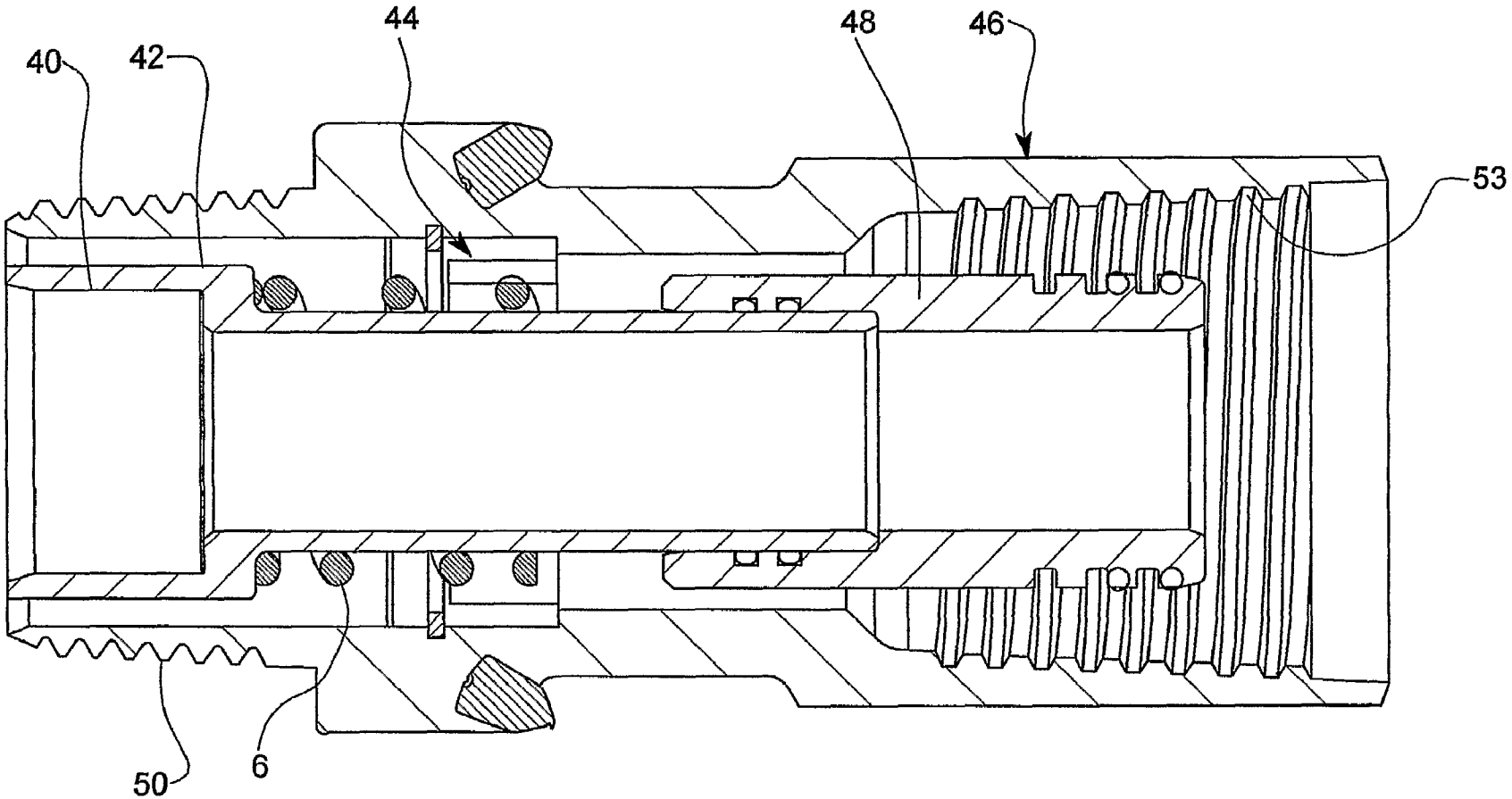
FIG. 3 is an enlarged view in axial section of an adapter forming an end part of the hammer and which is designed to screw into the upper end of the part of the hammer shown in FIG. 1C.

Referring to FIG. 1C and FIG. 2, the central tube 30 is located against forward (i.e. downward) axial movement by abutment of a conically tapering shoulder 32 at the lower end of an externally enlarged upper portion of the tube 30, with a correspondingly tapering shoulder 32*a* at the upper end of a longitudinal bore within an element 134 which is fixed within a tubular coupling member 36 which in turn is screwed into a screw threaded upper end of the outer casing 10. The upper end of the tube 30, in the assembled drilling apparatus, is received within a socket 40 at the lower end of a tubular member 42, (see FIG. 2A and FIG. 3) which is resiliently mounted within an adapter 46 which in turn is screwed into coupling member 36 to complete assembly of the hammer section of the drilling apparatus. The adapter 46 has an axial bore therethrough, within which member 42 is located coaxially. A helical compression spring 6 around an upper part, of reduced external diameter, of the member 42 acts between, on the one hand, an annular shoulder provided around an enlarged diameter part within which the socket 40 is provided and, on the other hand, a spider member 44 retained in a predetermined axial position in the bore through the adapter 46. At its upper end (to the right in FIG. 3) a junction base 48, in the form of an annular sleeve, is fitted over the upper end of the member 42 and is sealed with respect thereto by O-rings, the part 48 being adapted to fit sealingly within a lower end of a central tube (not shown) of conventional form, within the adjoining part of the drill string (not shown).

The member 46 is an adapter in the sense that it provides around its lower end a screw thread 50 complementary with a screw thread 52 around the upper end of the coupling member 36, whilst its upper end is provided with an internal screw thread 53, which may be any one of a variety of forms and dimensions of screw thread which may be provided at the lower end of the adjoining section of the drill string, there being a variety of different such third forms and thread sizes in current use in the drilling art. Thus, a plurality of adapters of the form shown in FIG. 3 and differing only in the form and/or size of the internal thread 53 at the upper end thereof may be provided, allowing the main portion of the hammer assembly to be fitted to or adapted to any of a variety of drill strings. When the adapter 46 is screwed into the upper end of the portion of the hammer assembly shown in FIG. 1C, the upper end of the tube 30 is received within the socket 40 and will reach the limit of its possible insertion into the socket 40 before the adapter is fully screwed home into the upper end of the member 36 so that during the final part of the screwing in of the adapter, the socket 40 will be displaced rearwardly, relative to the body of the adapter, against the force of the spring 6, so that thereafter the tube 30 is resiliently clamped between the shoulder 32 and the socket 40. As a result, longitudinal movement of tube 30 within the hammer assembly is restrained by the action of the spring 6 and such axial movement as does take place is effectively damped.

The tube 30 is required to be a close sealing fit within, (a) the upper end of the axial bore within the drill bit; (b) within a central region of the piston 24 and (c) within the element 134. In order to facilitate removal of the tube 30, when necessary, the part of tube 30 just below (i.e. closer to the drill bit than) the tapering shoulder 32 and fitting within the member 134 is of slightly greater diameter than the part of the exterior of the tube 30 which is required to be a sealing fit within the middle part of the piston 24 and that part of the tube 30 is, in turn, slightly larger than the lower end part which is a substantially sealing fit within the lower part of the axial bore in the drill bit 14. Thus, the tube 30 has "sealing and location diameters" of progressive increasing sizes, the smallest being at the drill bit end, sealing the tube in the drill bit, and the largest at the opposite end where the one-way valve and the locating/sealing journal are located. This arrangement allows the tube 30 to be withdrawn through a one-way valve arrangement, (see below), etc., without difficulty.

A one way valve arrangement 115, (FIG. 2), is slidably mounted on the tube 30 just above the upper end of the element 134. The portion of the tube 30 which extends through this one way valve arrangement is, again, somewhat larger in diameter than the portions below Preferably the part of the tube 30 between the element 134 and the piston is of the same diameter as the part which extends sealingly through the piston 24 and the part of the tube 30 below the piston 24 is of the same external diameter as the lower end of the tube 30. The slope of the tapering shoulders 32, 32*a* is selected to be greater than would result in the tube 30 jamming in the element 134.

Figure 4:
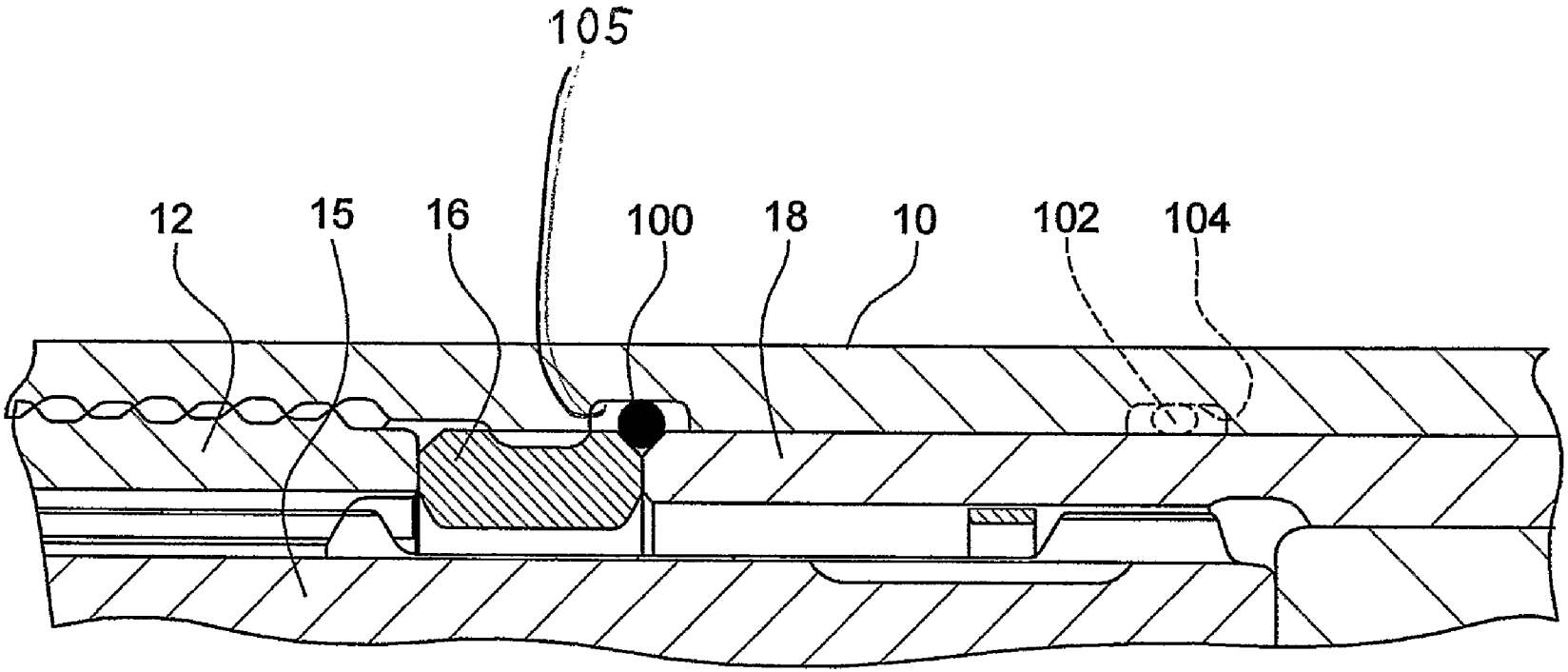
FIG. 4 is an enlarged view of part of the hammer shown in FIG. 1A.

Referring to FIGS. 1A and 1B, it will be understood that the element which, in normal use, principally prevents the guide bush or cyclic regulator 18 from sliding downwards within the outer casing 10, is the split ring 16. Once the drive sub 12 is unscrewed from the casing 10, for example to allow replacement of the bit 14, all that restrains the guide bush 18 from sliding downwardly out of the outer casing, (assuming, of course, the outer casing still to be in a vertical position with the end which is uppermost during drilling still uppermost), is an O-ring 100, best shown in the detail view of FIG. 4. Conventionally, this retaining function is provided by an O-ring, such as illustrated in dotted lines at 102 in FIG. 4, accommodated within an internal circumferential groove 104 around the casing 10 and which O-ring 102 frictionally engages the exterior of the guide bush. However, if it becomes necessary to extract the guide bush, for example during disassembly of the hammer entirely, it becomes then very difficult to extract the bush 18 because if the bush is drawn downwardly the O-ring 102 tends to become jammed between the lower edge of the groove 104 and the exterior of the guide bush. In the preferred embodiment of the invention illustrated, an O-ring in the position indicated at 102 is dispensed with and instead an O-ring 100 is provided at the location between the junction of the split ring and the lower end of the guide member. The split ring 16 and the lower end of the guide member 18 are being externally beveled as shown so as to present, together, a V-section groove around the combination of the split ring and the guide bush within which the O-ring 100 is engaged, the O-ring 100 being in turn accommodated within a shallow groove 105 around the interior of the outer housing. Thus, once the sub 12 has been unscrewed and removed, with the drill bit and the split ring 16, from the outer housing 10, the O-ring 100 can be readily extracted, whereupon the guide bush is free to slide downwardly out of the outer casing.

The bush 18 provides passages through which compressed exhaust air from the hammer arrangement can pass, via various further passages as described below, to the working face of the drill bit head. Thus, the porting arrangement in the piston 24 and the cylinder in which it reciprocates is arranged so that exhaust air passes through inclined passages 26 in the piston to an annular section passage 27 defined between, on the one hand, the lower end of the axial bore through the piston and, on the other hand, the exterior of the tube 30. At its lower end this annular passage connects with a further annular passage 27A defined between the tube 30 and the axial bore through the drill bit shank. This passage 27A in turn connects with inclined passages 28 in the drill bit head. A lower end portion of the axial bore in the drill bit is of lesser diameter than the remainder of that bore above and receives the lower end of the tube 30 as a close effectively sealing sliding fit whereby the annular passage 27A around tube 30 does not communicate directly with the bore within the tube 30. As illustrated and as noted above, an intermediate part of the axial bore through the piston is a close sliding fit on the tube 30 whereby this intermediate portion defines the upper end of said annular section passage 27 around the tube 30. Exhaust air from the hammer piston and cylinder arrangement can thus pass through the annular section passage 27A between the tube 30 and the drill shank axial bore, and thence through the inclined passages 28 in the drill bit head to pass around the outside of the drill bit to the face of the drill bit, then, with entrained debris from the hole being drilled, up through holes in the drill bit face and further passages 33 within the drill bit, to the central longitudinal bore in the drill bit shank, and thence, via the interior of tube 30, up to the ground surface.

A bit catcher sleeve 34 is carried at the lower end of the outer housing 10, and extends past the lower end of the drive sub and over an upper portion of the drill bit head. The bit catcher sleeve 34 is generally cylindrical and co-axial with the drill hammer and bit. The bit catcher sleeve is of a substantially constant external diameter, except for a frustoconical or chamfered part at its upper end, said external diameter being somewhat greater than that of the outer casing 10 and substantially the same as the greatest diameter of the drill bit head. The interior of the bit catcher sleeve 34 is defined by a stepped axial through bore through which extend the drive sub and the drill bit. The axial bore through the bit catcher sleeve has a first diameter adjacent its upper end which is great enough for the uppermost, externally screw threaded portion of the drive sub to pass through and which is a close fit over an externally unthreaded portion 12A of the sub, just below said threaded portion of the drive sub. The lower end 12B, (also cylindrical and unthreaded), of the drive sub is externally of a diameter greater than part 12A and is received in a portion of the axial bore through the bit catcher sleeve which is of a complementary, second, diameter. The externally screw-threaded part of the drive sub is screwed into the lower end of casing 10. The upper end of the bit catcher sleeve is clamped axially between the lower end of the outer casing 10 and an annular shoulder around the drive sub extending from portion 12A to portion 12B, the last-noted shoulder engaging an opposing annular shoulder extending between the first and second diameter portions of the bore through the bit catcher sleeve.

As shown in FIGS. 1A and 1B, the drill bit head has, at its upper end, a circumferential rib 136 defined between the upper end of the drill bit head and a circumferential groove 38 around the drill bit head. The diameter of the drill bit head, at the location of this circumferential rib 136, is such that it is a sliding fit in a lower part of the bit catcher sleeve, which extends over said rib 136. At its extreme lower end the bit catcher sleeve has an inwardly directed lip or flange 140 which thus extends below the rib 136, into said circumferential groove 38.

FIG. 1B shows the position of the drill when the drill string is raised so that the drill bit is no longer in engagement with the end of the bore being drilled, but is suspended from the hammer. This is the position adopted in the so called "flushing mode", and also, of course, when the drill string is being lifted out of the borehole. Normally the weight of the drill bit in this position is carried by the split ring 16 and the inwardly turned lip or flange 140 at the lower end of the bit catcher 34 is just clear of the rib. However, in the event of the drill bit fracturing, which typically results in separation of the larger diameter bit head from the smaller diameter drill bit shank in the region where these two parts meet, the drill bit head will remain supported by the bit catcher sleeve by engagement of the inwardly directed lip 140 on the sleeve with the rib 136 around the drill bit, so that the drill bit head can be extracted from the bore being drilled. A similar arrangement is described in our co-pending UK Patent Application No. 0204904.7 (GB 2385869). In order to allow the lip 140 at the lower end of the bit catcher sleeve to be extended over the circumferential rib 136 on the drill bit head during assembly of the hammer and drill arrangement, the lip and circumferential rib are provided with complementary screw threads (not shown) so that the lip can be screwed onto and over the circumferential rib. Because, in use, the lip and annular rib are never in direct engagement, the screw threaded parts are not particularly vulnerable to damage.

It will be noted that in both the drilling mode—i.e. the position shown in FIG. 1A—and in the flushing mode shown in FIG. 1B, a small amount of high pressure exhaust air from the piston mechanism, and which carries, in manner known per se, a lubricant (e.g. in mist form), is able to pass between the co-operating end faces of the piston rod 22 and of the upper end of the drill bit shank, and thence to pass, through the bore of the retaining ring 16, and through the spaces between the drill bit splines and the co-operating splines of the sub 12, so as to reduce fretting on the drive spline contact faces. The high pressure air also causes pressurisation across the bleed area between the chuck, (sub), and the drill bit shank and reduces ingress of water and silt.

As noted above, in the arrangement illustrated, the tube 30 is a close sliding fit in the lowermost part of the axial bore through the drill bit and drill bit shank, this lowermost part being of smaller diameter than the part of said bore above, and an annular passage 27A for exhaust compressed air from the pneumatic hammer mechanism is thus defined between the exterior of tube 30 and the larger diameter part of the axial bore through the drill bit shank. This annular passage connects with inclined bores 28 through the drill bit head which open into a circumferential groove 142 around the drill bit head adjacent the lower end of the drill bit. Longitudinal slots or flutes 144 on the periphery of the part of the bit below said groove allow compressed air from this groove to pass to the working face of the drill bit to entrain debris from the rock drilling into an air current which passes through further passages 33 in the drill bit to the lower end of the axial bore in the drill bit and thence upwardly through the tube 30.

The drill bit head has a peripheral cylindrical band or collar portion 148 just below the groove 38 and above groove 142 and which is of a diameter which is as great as the largest diameter of the drill bit head elsewhere. Thus, in use, the band or collar 148 is close to the wall of the bore being drilled and forms a seal or near-seal, with respect to the wall of the bore being drilled, against the passage of exhaust air. The bit catcher sleeve 34 is preferably provided with a hardness comparable with that of the body material of the bit head, so as to wear at the same rate as the bit head, particularly the band 148. The bit catcher 34 is preferably keyed to the drive sub 12, to stop it spinning in the borehole if it becomes tight in the bore hole.

The hole sealing collar portion 148 behind the drill bit cutting face has several functions. Firstly, as noted above, it seals the drilled borehole, so that the exhaust air is forced up the drill bit and through the tube 30. Thus, the sealing collar 148 minimises leakage of the cuttings to the surface via the outside annular passage between the borehole and the exterior of the hammer and drill string. The sealing collar will wear on the outside, in service, to maintain a diameter corresponding to or slightly less than the drill bit cutting face diameter.

Exhausting air via the side venting passages 28 in the drill bit which exit below the hole sealing collar 148 and above the drill bit cutting face creates a curtain of air due to the profiled face of the annular groove 142 below the collar. This curtain of air is deflected down towards the cutting periphery of the drill bit, and through the grooves or flutes 144 on the periphery of the drill bit, and forces the drilled cuttings across the drill bit face towards the main excavation holes 33 in the drill bit face.

When the hammer is put into the 'flushing mode' (cf. FIG. 1B and FIG. 6), since the drill collar 148 is integral with the drill bit head the distance from the drill bit cutting face and the collar does not change. This benefits the flushing mechanism as there is no drop in the air pressure when the apparatus is placed in the 'flushing mode', as a fixed volume is maintained for the exhausting air to vent into. Hence the air velocity is kept from dropping and a high excavation rate of the cuttings can be maintained. An added benefit is that in loose formations the cavity created by the air blast at the base of the borehole will be restricted to the short distance between the cutting face and the lower edge of the sealing collar.

In the present specification "comprises" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

The invention claimed is:

1. A drill bit for a reverse circulation rock drill, the drill bit having a head with a working face and a shank of reduced diameter as compared with the working face, the drill bit having one or more intake holes in the working face leading to a passage extending up the drill bit shank, the drill bit head having, at a location spaced from the working operative face, a circumferential band or collar providing a cylindrical external surface coaxial with the drill bit, the diameter of said circumferential band or collar being substantially equal to the effective diameter of the working face of the drill bit and not less than the diameter of any other part of the drill bit, the drill bit having a circumferential groove around its exterior, below said circumferential band or collar and having passages for exhaust air discharging into said groove, whereby such air can pass around the front of the drill bit and across said face to exit through said intake holes.

2. A drill bit according to claim 1 wherein the drill bit, below said circumferential groove has an exterior surface in the form of a cylinder interrupted by grooves extending longitudinally to the working face of the drill bit, for the passage of exhaust air to said working face from said circumferential groove.

3. A drill bit according to claim 1 wherein above said circumferential band or collar, the drill bit has a further circumferential groove, directly below a circumferential rib which is of reduced external diameter as compared with said circumferential band or collar and which is provided for engagement by a bit catcher sleeve.

4. A drill bit according to claim 2 wherein above said circumferential band or collard, the drill bit has a further circumferential groove, directly below a circumferential rib which is of reduced external diameter as compared with said circumferential band or collar and which is provided for engagement by a bit catcher sleeve.

* * * * *

UNITED STATES PATENT AND TRADEMARK OFFICE

CERTIFICATE OF CORRECTION

PATENT NO. : 7,467,674 B2
APPLICATION NO. : 10/599621
DATED : December 23, 2008
INVENTOR(S) : Christopher James Green It is certified that error appears in the above-identified patent and that said Letters Patent is hereby corrected as shown below:

On the Title Page, Item (74) Attorney, Agent, or Firm -- "Carlo A. Marmo;" should be --Carol A. Marmo--.
On the Title Page, second column, in the Abstract, line 1 of the Abstract, "assembly a" should be --assembly--.
On the Title Page, second column, in the Abstract, line 2 of the Abstract, "a axially" should be --an axially--.
Column 2, line 1, "having and upper end" should be --having an upper end--.
Column 2, line 62, a period --.-- should be inserted after "mode))".
Column 2, line 67 "inserts" should be --insert--.
Column 4, line 53, a period --.-- should be inserted after "below".
Column 8 line 50, "collard" should be --collar--.

Signed and Sealed this

Ninth Day of June, 2009

JOHN DOLL
*Acting Director of the United States Patent and Trademark Office*